United States Patent [19]

Josten et al.

[11] Patent Number: 4,803,850

[45] Date of Patent: Feb. 14, 1989

[54] APPARATUS AND METHOD OF DISPENSING PARTICULATE ICE AND COLD BEVERAGE WITH IRREVERSIBLE SEPARATION OF COOLING ICE

[75] Inventors: Marvin H. Josten, Garner, Iowa; Henry C. Kovar, Anoka, Minn.; Kenneth W. Schneider, Moson City, Iowa

[73] Assignee: Schneider Metal Manufacturing Co., Mason City, Iowa

[21] Appl. No.: 158,510

[22] Filed: Feb. 22, 1988

[51] Int. Cl.[4] ..... B67D 5/62

[52] U.S. Cl. ..... 62/98; 62/344; 62/396; 222/135; 222/146.6

[58] Field of Search ..... 62/344, 396, 398, 98; 222/135, 146.6, 242, 410

[56] References Cited

U.S. PATENT DOCUMENTS

| | | | |
|---|---|---|---|
| 2,358,756 | 9/1944 | Zoller et al. | 62/396 X |
| 2,871,675 | 2/1959 | Cornelius | 62/398 X |
| 3,456,452 | 7/1969 | Hilbert | 62/396 X |
| 4,300,359 | 11/1981 | Koeneman et al. | 62/344 X |
| 4,423,830 | 1/1984 | Lonts et al. | 62/394 X |
| 4,641,763 | 2/1987 | Landers et al. | 62/398 X |
| 4,651,538 | 3/1987 | Bull et al. | 62/398 |
| 4,678,104 | 7/1987 | Pritchett | 62/344 X |
| 4,679,715 | 7/1987 | Hovinga | 62/344 X |

*Primary Examiner*—William E. Tapolcai
*Attorney, Agent, or Firm*—Henry C. Kovar

[57] ABSTRACT

A method of and apparatus for dispensing both particulate ice and cold beverage wherein a common supply of ice is used firstly for dispensing and then secondly for cooling of the beverage. A pair of co-axial rotors are co-rotated about a common vertical axis by a single motor, the upper rotor dispenses particulate ice off of an annular upper bottom. All ice that falls through the open center of the upper bottom irreversibly falls down upon a cold plate and the lower rotor moves the fallen cooling ice on the cold plate for enhanced cooling.

21 Claims, 2 Drawing Sheets

14

10

APPARATUS AND METHOD OF DISPENSING PARTICULATE ICE AND COLD BEVERAGE WITH IRREVERSIBLE SEPARATION OF COOLING ICE

BACKGROUND OF THE INVENTIONS

1. Field of the Invention

The invention pertains to a method of and apparatus for dispensing both particulate ice and cold beverage wherein a common supply of ice is used firstly for dispensing and then secondly for cooling of the beverage, with irreversibility so that cooling ice is never dispensed.

2. The Prior Art

C. M. Lents U.S. Pat. No. 4,423,830 has a rotary ice dispensing rotor directly atop a cold plate. The same ice is used for both cooling and dispensing. Lents is commercially successful. The problem with using the same ice for dispensing and cooling is that the ice picks up metal as it is moved about on a cold plate, and the trace metallic content in the beverage is questionable and/or objectionable. Regardless, marketing efforts to improve the quality of dispensed cold beverage demand separation of ice for dispensing and cooling.

D. G. Hovinga U.S. Pat. No. 4,679,715 is an example of a device for separating ice into dispensing and cooling fractions. The market wants improvements over the beverage cooling performance of Hovinga. The structural requirements of the Hovinga drive mechanism are extremely high and expensive to satisfy, and higher volumetric capacity of the ice bin is being demanded by the market.

OBJECTS OF THE INVENTION

It is an object of this invention to provide a method of and apparatus for dispensing both particulate ice and cold beverage, with the use of a common supply of ice for both dispensing and cooling and in which ice destined for cooling is irreversibly separated from the common supply so that it cannot be dispensed.

SUMMARY OF THE INVENTION

According to the principles of the present invention, apparatus for dispensing particulate ice and beverage has an ice bin with a cold plate in the bottom, an ice dispensing chute spaced above the cold plate, an ice dispensing rotor spaced upward from the cold plate, and a generally toroid shaped upper bottom under the rotor and spaced upward of the cold plate, an aperture in the upper bottom is over the cold plate for dropping ice from a dispensing zone into a discrete cooling zone.

Apparatus for dispensing particulate ice and cold beverage has a cold plate providing a lower bottom surface of an ice bin, a generally toroidal upper bottom spaced upward from the cold plate, an ice dispensing rotor above the upper bottom, a cooling ice rotor between the upper bottom and the cold plate, a drive connection through the upper bottom and connecting the rotors, and a single motor for turning both rotors.

A method of dispensing particulate ice and cold beverage has the steps of rotating particulate ice atop an upper bottom, dropping part of the ice past the upper bottom, and rotating the dropped ice on a cold plate to cool beverage.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
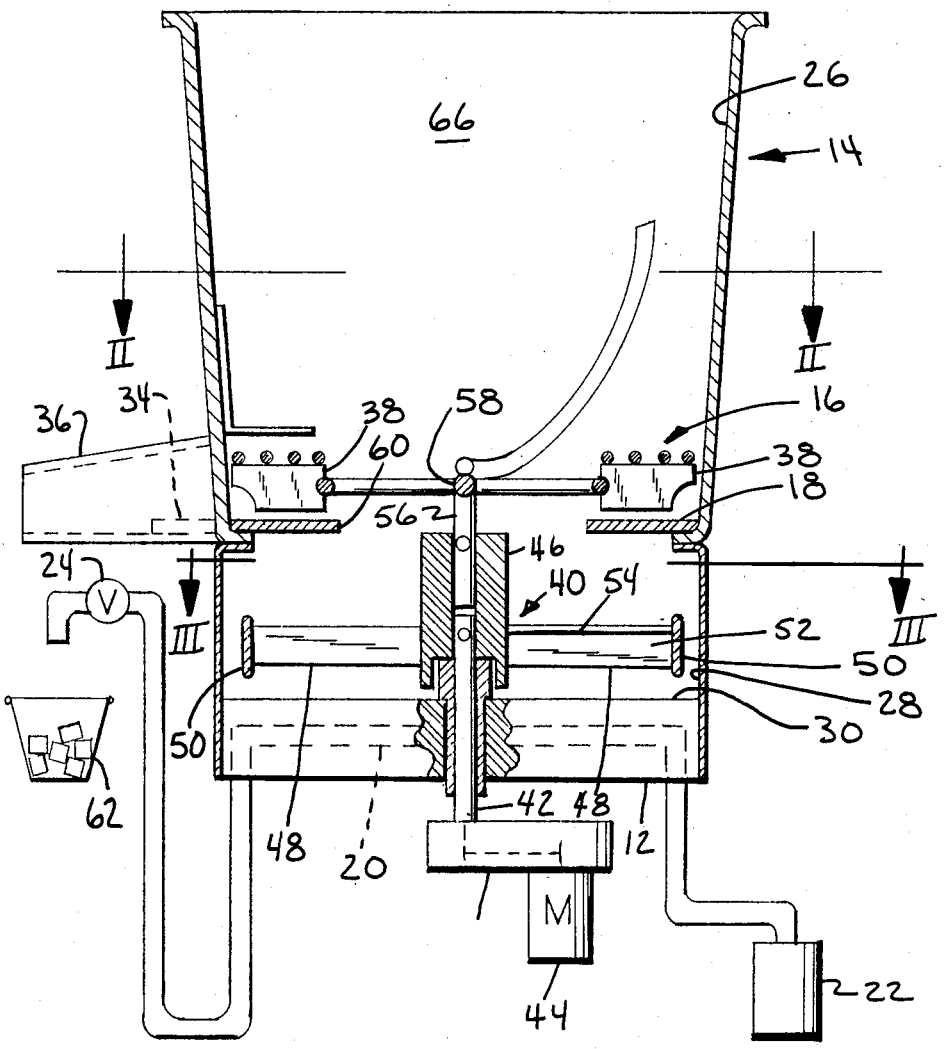
FIG. 1 is a schematic elevational section view of the preferred embodiment of the present invention.

According to the principles of the present invention, an apparatus for dispensing particulate ice and for cooling and dispensing cold beverage is shown in FIG. 1 and generally indicated by the numeral 10. The apparatus 10 has a cold plate 12, an ice bin 14, an ice dispensing rotor 16, and a generally toroidal shaped upper bottom 18. The cold plate 12, ice bin 14 and dispensing rotor 16 are essentially similar to what is shown and disclosed in commonly owned C. M. Lents U.S. Pat. No. 4,423,830 which incorporated hereto by reference. The reader is referred to U.S. Pat. No. 4,423,380 for an extensive and detailed discussion of these components and the fine points of their functions.

The cold plate 12 is conventional and has an inner beverage cooling coil 20 having an inlet end fluidly connected to a source of beverage 22 and an outlet end fluidly connected to a beverage dispensing valve 24. The bin 14 is jointly formed by upper storage chamber walls 26 which sit atop lower cooling chamber bin walls 28 mounted to the cold plate 12. The upper surface 30 of the cold plate 12 forms the true bottom or the lower bottom of the bin 14. The upper bottom 18 rests upon a ledge 32 of the bin 14 and has an anti-rotation indexing finger 34 which extends into the ice dispensing outlet chute 36 and prevents rotation of the upper bottom 18. The dispensing chute 36 and the upper bottom 18 and the dispensing rotor 16 are all spaced upward from and above the cold plate 12.

The dispensing rotor 16 has a plurality of paddlewheels 38 for pushing particulate ice off of the upper bottom 18 and out the chute 36. The dispensing rotor 16 is elevated above the upper bottom 18 so that all of the paddlewheels are held up and off of the upper bottom 18. Note that the upper bottom 18 could also be referred to as the dispensing bottom and the lower bottom 30 could be referred to as the cooling bottom 30 to further and functionally distinguish the bottom 18, 30 from each other.

Figure 3:
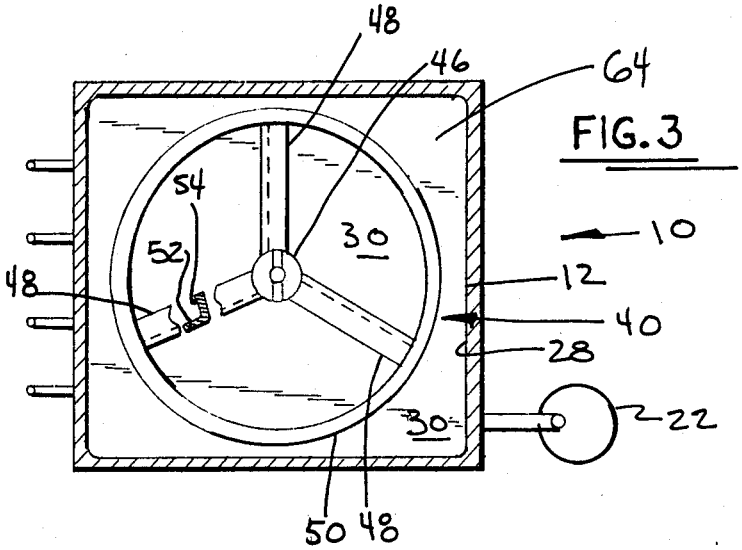
FIG. 3 is a plan view taken through lines III—III of FIG. 1.
Figure 2:
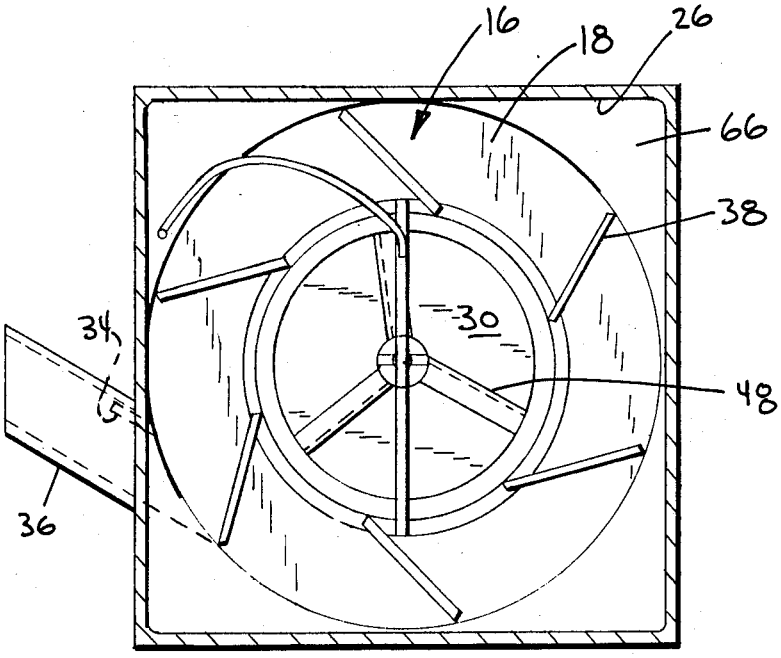
FIG. 2 is a plan view taken through lines II—II of FIG. 1.

Underneath and spaced from the upper bottom 18 is a cooling ice rotor 40. The cooling ice rotor 40 sits on and is keyed to a drive shaft 42 coming into the ice bin 14 from a single gearbox and electric motor 44. The cooling motor is spaced upward of and held off of the cold plate upper surface 30. The cooling rotor 40 has a hub 46, a plurality of radial spokes 48, and a diametric outer ring 50 which is spaced inwardly of the cooling chamber sides 28 which are preferably square as seen in FIG. 3. Each spoke 48 has a vertical pusher surface 52 to push ice on the cold plate 12 and a leading edge 54 to bias ice downward against the cold plate 12. The diameter of the ring 50 is just slightly less than the opening within the ledge 32. The dispensing rotor 16 has a drive hub 56 which drops into and keys to the cooling rotor hub 46 so that both rotors 16, 40 are co-connected to the drive shaft 42 for common co-rotation when driven by the motor 44. The dispensing rotor 16 is liftable upward and freely disengages from the hub 46. The upper bottom 18 merely rests upon the ledge 32 and is easily pulled up and out of the bin 14. The cooling rotor 40 then lifts up and off of the shaft 42 and out of the bin 42. The dispensing rotor 16 has a rotatable breaker bar 58 atop of the shaft 56 in a general T-shape. The hub 46 and shaft 56 extend directly through the drop aperture 60 in the upper bottom 18.

The drop aperture 60 is generally centered under the dispensing rotor 16 and above the cooling rotor 40 and the cold plate 12. The drop aperture 16 is of smaller diameter than the ring 50. The ring 50 forms a circumferential hoop in the cooling rotor 40 to hold ice in off of the walls 28.

In operation and use of the apparatus 10, and in the practice of the method of the present invention, a common quantity of particulate ice is dumped into the bin 14. Some of the ice falls through the aperture 60 and into the cooling rotor 40 and onto the cold plate 12 for cooling beverage in the coils 20. Some of the ice remains above the upper bottom 18 and in the dispensing rotor 16. A cup 62 is placed in position under the ice chute 36 and the motor 44 is started. Both rotors 16, 40 revolve and ice is pushed out into the cup 62. Ice in the cooling rotor 40 is moved around on the cold plate 12 and melted to cool beverage. All ice that falls through or is dropped through the aperture 60 is irreversibly dropped into the cooling chamber 64 and can never be returned upwards to the dispensing chamber 66. Ice is continually moved around on the cold plate 12 and extremely high heat transfer is attained per unit of surface area on the cold plate 12.

Although other advantages may be found and realized, and various and minor modifications suggested by those versed in the art, be it understood that we wish to embody within the scope of the patent warranged hereon, all such embodiments as reasonably and properly come within the scope of our contribution to the art.

We claim as our invention:

1. Apparatus for dispensing particulate ice and beverage, comprising:

a. an ice bin having upright walls;

b. a cold plate in a bottom of the bin, said cold plate having heat exchange means for cooling beverage flowing therethrough by melting of ice in the bin and atop the cold plate; said cold plate having a fluid inlet connectible to a source of beverage and an outlet connectible to a beverage dispensing valve;

c. an ice dispensing chute spaced upwardly from the cold plate and extending outwardly from the bin;

d. an ice dispensing rotor directly above and spaced upward from the cold plate, said rotor being selectively rotatable about an upright axis, for expelling particulate ice out of the bin and into the dispensing chute, said rotor having a plurality of arcuately spaced apart paddlewheels on the outside of the rotor for said expelling of the ice into the chute and an opening through a central section of the rotor; and e. a generally toroidal shaped upper bottom directly under said rotor, said upper bottom being spaced upwardly of said cold plate and being generally coplanar with said chute, said upper bottom having an aperture under said rotor central section opening for irreversible passage of ice downward from a dispensing level above the upper bottom to an exclusive cooling level below the upper bottom.

2. Apparatus according to claim 1, in which said upper bottom removably rests upon an upward facing ledge in said bin. .

3. Apparatus according to claim 2, in which said upper bottom is anti-rotationally indexed to said dispensing chute, the outer perimeter of the upper bottom and that part of the bin at the same level as the paddlewheels being generally round.

4. Apparatus according to claim 1, including a second and cooling ice rotor atop of the cold plate and below the dispensing rotor, for movement of cooling ice on the cold plate.

5. Apparatus according to claim 4, in which said rotors are operatively connected to a common drive shaft and are co-rotatable about a single common axis.

6. Apparatus according to claim 5, including a first coupling connecting the cooling rotor to said drive atop the cold plate, and a second coupling connecting the dispensing rotor to the cooling rotor.

7. Apparatus according to claim 5, wherein said cooling rotor has means for supporting the dispensing rotor with the paddlewheels up and off of the upper bottom.

8. Apparatus according to claim 5, including an outer perimeter ring on said cooling rotor, said ring being of larger diameter than said aperture.

9. Apparatus according to claim 4 in which said upper bottom is spaced above and is vertically separated from said cooling rotor.

10. Apparatus according to claim 4, including a ledge spaced upward from the cooling rotor, said upper bottom being supported on said ledge and spaced above said cooling rotor, said cooling rotor being of lesser diameter than said ledge.

11. Apparatus according to claim 4, in which said cooling rotor is of smaller diameter than said dispensing rotor.

12. Apparatus according to claim 8, in which said ring is spaced inwardly from said bin walls.

13. Apparatus according to claim 1, including an ice breaker in said rotor central section and rotatable over the aperture.

14. Apparatus for dispensing particulate ice and cold beverage, comprising:

a. a cold plate having an inlet connectible to a source of beverage and an outlet connected to a cold beverage dispensing valve;

b. a plurality of walls extending upward from the cold plate and jointly forming an ice bin, with the cold plate providing a lower bottom of the bin;

c. a generally toroidal upper bottom in the bin, said upper bottom being spaced upward from said cold plate and having a central aperture over the cold plate;

d. a particulate ice dispensing rotor above the upper bottom;

e. an ice dispensing chute extending from said bin and disposed to be fed particulate ice by said dispensing rotor;

f. a cooling ice rotor between the upper bottom and cold plate;

g. a drive connection extending through the aperture and connecting the two rotors to each other for corotation; and h. a single motor operatively connected to turn said rotors.

15. Apparatus according to claim 14, including means above said cold plate for restraining ice moving upon the cold plate to a circular path.

16. Apparatus according to claim 15, wherein said restraining means comprises a circular hoop on the outside of the cooling ice rotor.

17. Apparatus according to claim 16, in which said aperture is of smaller diameter than said hoop, said aperture being directly above the hoop for dropping ice into the hoop.

18. Apparatus according to claim 14, including means on said cooling ice rotor for biasing particulate ice downward against the cold plate.

19. A method of dispensing ice and cold beverage, comprising the steps of:

a. rotating particulate ice in an ice bin and atop of a toroid shaped upper bottom spaced upward from a cold plate and dispensing the rotating ice off of the upper bottom and out of the bin with a dispensing rotor atop of the upper bottom;

b. irreversibly dropping a portion of the particulate ice through the rotor and through a central aperture in the upper bottom to a cold plate below and spaced from the upper bottom;

c. rotating the dropped ice around an upper surface of the cold plate with a discrete cooling rotor; and d. dispensing beverage out of the cold plate while melting the dropped ice thereon to cool the beverage.

20. A method according to claim 19, wherein the dispensing and cooling rotors are interconnected and commonly rotated about a single generally vertical axis.

21. A method according to claim 19 including the step of restraining the dropped ice inward from side walls of an ice bin, during rotation of the dropped ice atop of the cold plate.

* * * * *